United States Patent [19]

Riddoch

[11] Patent Number: 4,831,372

[45] Date of Patent: May 16, 1989

[54] DISPLAY APPARATUS

[75] Inventor: Henry J. Riddoch, Kowloon, Hong Kong

[73] Assignee: Astec International Ltd., Kowloon, Hong Kong

[21] Appl. No.: 912,952

[22] Filed: Sep. 29, 1986

[51] Int. Cl.[4] ..... G09F 9/37; G09F 11/34

[52] U.S. Cl. ..... 340/788; 340/783; 340/763; 340/815.05; 40/449

[58] Field of Search ..... 340/763, 764, 778, 783, 340/788, 815.02, 815.04, 815.26, 815.05; 350/267, 359, 360, 485; 40/449, 463, 546; 116/204

[56] References Cited

U.S. PATENT DOCUMENTS

| | | | |
|---|---|---|---|
| 3,516,185 | 6/1970 | Paine et al. | 340/788 |
| 3,530,606 | 10/1968 | O'Keefe | 340/788 |
| 3,825,727 | 7/1974 | Passien | 340/815.26 |
| 3,916,403 | 10/1975 | Mandzsu et al. | 340/815.04 |
| 3,935,571 | 1/1976 | Sargent | 340/788 |

FOREIGN PATENT DOCUMENTS

| | | | |
|---|---|---|---|
| WO8402414 | 12/1983 | PCT Int'l Appl. | 40/449 |

*Primary Examiner*—Donald J. Yusko
*Assistant Examiner*—Alvin Oberley
*Attorney, Agent, or Firm*—Fitch, Even, Tabin & Flannery

[57] ABSTRACT

A magnetically actuated information display device is disclosed which includes a rigid, permanently magnetized display segment movably mounted in a non-magnetic chamber having a transparent viewing window and containing an opaque fluid whose color contrasts with the color of the display device. A core affixed to the rear of the chamber is capable of being selectively magnetized so as to repel or attract the display segment, according to the selected magnetic polarity of the core. Repulsion of the display segment by the core causes the display segment to move toward the transparent window through which the color of the display segment may be viewed as the opaque fluid is displaced away from the transparent window. Attraction of the display segment by the core causes the display segment to move away from the transparent window thereby allowing the opaque fluid to obstruct viewing of the display segment. In this position, the color of the opaque fluid is viewed through the transparent window. Bistability of the device is achieved by the residual magnetism in the core acting on the permanently magnetized display segment. A plurality of display devices may be combined in an array to form a display panel.

31 Claims, 4 Drawing Sheets

DISPLAY APPARATUS

BACKGROUND OF THE INVENTION

The present invention relates to magnetically actuated information display devices.

Display panels which consist of multiples of discrete segments are widely used for the visual indication of information. Display panels using magnets or electromagnets are known in the art and employ various methods to communicate the information to the viewer. The magnetism applied in such devices causes the change of information presented and also maintains the presentation of the information after the change has occurred. A luminous display device is described in U.S. Pat. No. 3,825,927 to Passien. That invention teaches the use of disks or slugs disposed in a chamber between the poles of an electromagnet. One wall of the chamber contains an opening through which light shines from a light source external to the chamber. By selective amplification of energy to the electromagnet, the disks or slugs may be moved from one position in which they cover the opening in the chamber wall to another position in which the opening in the wall is exposed and light shines around the periphery of the disks or slugs and can be viewed from the exterior of the device through a transparent wall of the chamber. A disadvantage of this arrangement is that it requires a self-contained light source for indication of information and also requires continuous excitation of the electromagnets even after the change of position has been achieved to maintain the disks in position. Thus, the device does not have bipolar stability.

Another display panel is described in U.S. Pat. No. 3,698,793 to Tellerman. This device teaches the use of a viewing panel which includes a light diffusing boundary. An electromagnet is used to press an opaque member against the inner surface of the light diffusing boundary, thereby displaying to the viewer the color of the opaque member. One disadvantage of this device is that the color density displayed to the viewer depends on the relative pressure applied to the opaque member. Furthermore, the sharpness of the image displayed to the viewer may be reduced by irregularities in the contacting surfaces of the opaque member and the light diffusing boundary. This device also requires the continuous application of energy to the electromagnetic elements in order first to change and then to maintain the position of the opaque member. Thus, the device does not have automatic bipolar stability.

Yet another display panel is described in U.S. Pat. No. 3,916,403 to Mandzsu, et al. Mandzsu, et al. teaches a permanent magnet contained in a flip leaf which is pivotally connected to a base panel. The flip leaf has two surfaces, each of a different color. A reversal of the polarization state of a core under the panel causes the flip leaf magnet to be either repelled or attracted depending on the polarity state chosen. This residual magnetism in the core causes the flip leaf to either remain in its present position or to pivot to expose its other surface so as to change the color presented to the viewer. This device achieves bipolar stability as a result of this residual magnetism in the core of the electromagnet. The residual magnetism acts on the permanent magnet contained in the flip leaf so as to maintain the position of the flip leaf without the need for further application of external energy.

The flip leaf of this device is directly exposed to the viewer rather than being contained within a sealed chamber having a viewing panel. This display panel has the disadvantage of increased frictional wear on the colored surfaces of the flip leaf and on the pivot points of the flip leaf. Such wear may result in the loss of colored areas thereby reducing the quality of the information displayed. Such wear may ultimately result in the complete detachment of the flip leaf from its base panel.

Another display panel known in the art is described in U.S. Pat. No. 3,812,490 to Goodrich. This device teaches a flexible membrane impregnated with magnetic particles. A plurality of electromagnetic elements are energized to produce a desired polarity so as to selectively repel or attract the flexible membrane. The visibility of the outer surface of the flexible membrane in Goodrich is a function of its proximity to a transparent window. When the membrane is attracted to the electromagnetic elements, the opaque fluid of the chamber is present between the flexible membrane and the window, thereby preventing visualization of the membrane's surface from the exterior of the device. When the flexible member is repelled by the electromagnetic elements, the membrane is at least partially in contact with the inner surface of the window and can be seen from the exterior of the device. This device is bistable in that energy needs to be applied to a selected electromagnetic element only while changing the polarity of the electromagnetic element.

The Goodrich device has the disadvantage of producing an image to the viewer which may lack clarity or create a variance in color or color density and produce a fuzzy image. This is because the flexible membrane is continuous and the polarization of one or more but not all of the electromagnetic elements will result in a variation in proximity to the window of the various areas of the membrane. The portion of the flexible membrane over non-energized electromagnetic elements is furthest from the window whereas the portion of the membrane over energized elements is pressed into contact with the window. Between these two portions is an area of the membrane having intermediate proximity to the window. Since this membrane area is also in tension, there is a tendency for it to pull away from contact with the window when adjacent elements are not also repelling the membrane, thereby creating uneven contact of the membrane, and thus a poor quality image.

Yet another information display apparatus that is known in the art is a device which includes a display member mounted in a chamber containing an opaque fluid of a color that is in contrast with the color of the surface of the display member. The display member is seen through a transparent viewing face of the chamber when it is positioned in face-to-face contact with the transparent window. An elongated spigot is affixed to the rear of the display member. It includes a permanent magnet and slides in and out of an elongated recess formed from, and continuous with, the chamber. A coil surrounds the recess and, when energized, interacts with the permanent magnet of the spigot to produce either a repelling or an attracting force to move the spigot within the recess.

The movement of the spigot in this apparatus depends on the continued application of electrical energy to the coil surrounding the recess of the chamber. This is because the apparatus does not teach a stationary core within the coil which can be selectively polarized in one of two states upon energization of the coil. Absent such a core, there can be no retention of an amount of residual magnetism after de-energization of the coil sufficient to drive the spigot to completion of its movement into either proximity with the transparent viewing face or with the rear face of the chamber, depending on the polarity of magnetism of such a core.

This type of device can be bistable, since the position of the display element can be maintained through the existence of surface tension, cohesion, or frictional forces between the face of the display member and the face of either the viewing face or the rear face of the chamber, depending on display element position. Position maintenance may also be achieved by the use of ferromagnetic elements disposed adjacent the recess which are attracted by either pole of the permanent magnet contained within the spigot. This involves only attractive forces.

This device has the disadvantage that it is a more complicated chamber structure, which increases manufacturing costs and decreases the ease of manufacturing. It also employs a less reliable means for achieving bipolar stability and may allow a variance in operational certainty in that the movable core defined by the spigot is subject to frictional or vibrational forces that may restrict or retard its movement.

It is evident from the above that while each of the described display devices relies on magnetism or electromagnetism for its operation, each has disadvantages which have not been overcome in a single device. Such disadvantages include the need to couple energy to each display element at least until travel has been completed, which causes slowness of operation and higher power needs, a dependence on a mechanical pivot that may wear out, a lack of bipolar position stability in the absence of power, a lack of high resolution of the displayed image, and a complexity of structure.

Accordingly, it is an object of the present invention to provide an improved means for displaying information and for changing the information so displayed.

It is another object of the present invention to minimize the duration and magnitude of energy that must be applied in order to initiate a change in the display of information.

It is a further object of this invention to provide for the retention of displayed information without the need for application of electrical energy to the device.

It is another object of the invention to minimize frictional interaction between mechanical components or surfaces in the display device.

It is yet another object of this invention to make possible the use of the display at any mounting angle.

It is yet another object of the invention to provide improved resolution of the displayed image.

It is a further object of the present invention to reduce the cost and to increase the ease of manufacturing of the device by the use of fewer materials, by reducing the size of the device, and by reducing the complexity of the structure of the device.

SUMMARY OF THE INVENTION

To achieve the above described objects, the present invention comprises a chamber of non-magnetic material including a transparent window and an opaque fluid contained within said chamber. A rigid, permanently magnetized display segment is movably mounted within said chamber to be movable between a first position in which a first face of the display segment is proximate said transparent, window and a second position in which the first face of the display segment is spaced from said transparent window and a second face of said display segment is proximate a rear face of said chamber. A magnetizable core is affixed adjacent said rear face of said chamber. Means are also provided for selectively producing one of a first or second magnetic polarity state in said core, said first polarity state generating a first residual magnetic field of sufficient strength to repel said display segment so that said display segment moves to said first position, said second polarity state generating a second residual magnetic field of sufficient strength to attract said display segment so that said display segment moves to said second position, said polarity state producing means and said first and second residual magnetic fields being insufficient to demagnetize said display segment. The permanently magnetized display segment is defined to have a magnetic field strength that is smaller than that required to reverse the magnetic polarity of said core.

In the preferred embodiment, the magnetizable core is composed of material of high magnetic remnance and low coercivity. One such material with this combination of characteristics is alnico. The core may be made of hard iron or a composite of hard iron and soft iron. A coil which surrounds the core is momentarily energized to selectively reverse the magnetic polarity state of the core. An electric current is generated in the coil in a first direction sufficient to generate a magnetic field whose strength causes the core to be in a first magnetic polarity state. An electric current is generated in a second direction in the coil sufficient to generate a second magnetic field whose strength causes the core to be in a second magnetic polarity state. The first polarity state generates a first residual magnetic field of sufficient strength to repel the display segment so that it moves to a first position adjacent the transparent viewing window and the second polarity state generating a second residual magnetic field of sufficient strength to attract the display segment so that it moves away from the transparent window towards a second position at the rear of the chamber. Displacement of the fluid by the movement of the display segment may be facilitated by providing sufficient clearance between the inside faces of the chamber and the periphery of the display segment or by providing holes through the display segment. Guiding members may also be provided to guide the movement of the display segment. Once the core has changed polarity, application of energy to the core is not needed to cause movement of the display segment.

The residual magnetism also serves to maintain the new position of the display segment, once achieved. The device is, therefore, bistable without requiring application of electrical energy to the device. The residual magnetism allows the display panel to be mounted at any angle.

An array comprising multiples of display devices according to the present invention may also be constructed. Such an array is capable of displaying any type of selected alphanumeric or graphic information, wherein each display segment constitutes one pixel of the displayed image. The display segments may operate independently and may be contained in a common fluid-filled chamber.

DETAILED DESCRIPTION OF THE INVENTION

Figure 1:
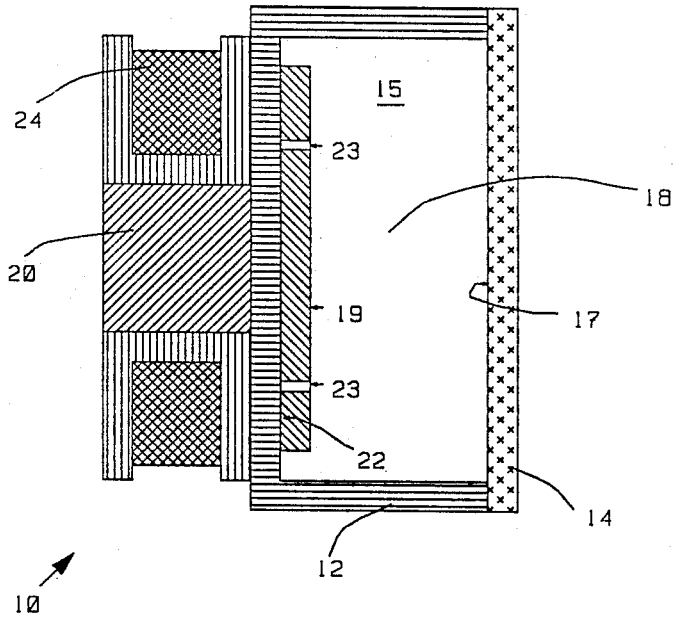
FIG. 1 is a cross-sectional view of a display device according to the present invention, showing the display segment in one position.
Figure 2:
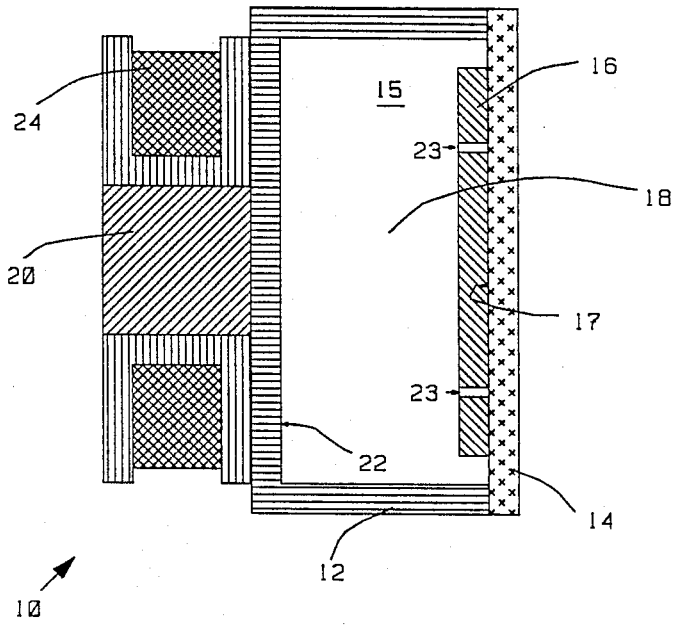
FIG. 2 is a cross-sectional view of the display device of FIG. 1, showing the display segment in a second position.

Referring to FIG. 1 and FIG. 2, shown is a cross-sectional view of a preferred embodiment of a display device 10 according to the present inventicn. The device 10 includes a chamber 12 made of non-magnetic material and a transparent window 14. The interior 15 of chamber 12 is sealed in order to contain an opaque fluid 18. A rigid, permanently magnetized display segment 16 is mounted in the chamber 12 so as to be able to move through the opaque fluid 18 toward and away from the inner surface 17 of the transparent window 14. The material of display segment 16 is preferably chosen to substantially match the specific gravity of opaque fluid 18 so that the segment 16 floats in essentially a fluid bearing formed by opaque fluid 18.

When the display segment 16 is in a first position proximate the transparent window 14, as shown in FIG. 2, the colored surface 19 of the display segment can be seen from the exterior of the device 10 through the window 14. When the display segment 16 is in a second position proximate the opposing surface 22 of the chamber, as shown in FIG. 1, the opaque fluid 18 between the display segment 16 and the window 14 obscures viewing of the colored surface 19. Thus, only the color of the opaque fluid 18 can be seen from the exterior of the device 10 through the window 14.

Typically, the distance that the display segment 16 moves between its first position proximate the transparent window 14 and its second position proximate the opposing surface 22, or vice versa, is approximately 4 mm–6 mm. The time required for this display segment 16 to travel forward to said first position, assuming, for example, a 30 mm square segment, is of the order of 80–10 ms. The time required for travel in the opposite direction to said second position is approximately 150–200 ms.

This faster movement when the display is starting from its second position is because the magnetic poles of the core 20 and display segment 16 are closest in this position. This greater repulsion force causes faster acceleration of segment 16 towards the front of chamber 12. Movement from the first position proximate to window 14 to the second position also takes longer due to the existence of surface tension between the display segment 16 and the window 14 which must be overcome. To speed up this breaking away, the surface tension may be reduced by making the surface of the display segment 16 that faces toward the window 14 rough or irregular. Holes shown at 23 in FIGS. 1 and 2 may also be formed in display segment 16, both to break this surface tension, and to facilitate movement of the display segment 16 through the opaque fluid 18. The movement of the display segment 16 may also be facilitated by providing sufficient clearance between the periphery of the display segment 16 and the chamber 12 to permit displacement of the opaque fluid 18.

The movement of the display segment 16 in the chamber 12 is accomplished by the interaction of the permanent magnetism of the display segment 16 with the residual magnetic force generated by the core 20. Core 20 is affixed to the rear of chamber 12, adjacent surface 22, and is surrounded by a coil 24. The core 20 may be made of hard iron or of a composite of hard iron and soft iron. Preferably, however, the core 20 is made of a material of high magnetic remnance and low coercivity, such as alnico.

The coil 24 may be energized by an electrical pulse of a selected polarity so as to magnetize the core 20 with a selected polarity. The duration of this pulse needed to reverse the magnetism of core 20 is a function of the amplitude of the pulse, the construction of the coil 24, and the size of core 20. For example, a 2 ms–3 ms pulse of 1 ampere applied to a coil 24 of 2500 turns is sufficient to ensure inversion of the magnetic polarity of a core 20 of 5 mm diameter. If the resulting polarity of the core 20 is the same as that of the permanently magnetized display segment 16, a repelling force is established which causes the display segment 16 to move toward the transparent window 14. If the resulting polarity of the core 20 is opposite that of the display segment 16, an attractive force is established so that the display segment 16 moves toward the opposing surface 22, away from window 14. Note that the magnetic material used to make the display segment 16 permanent magnet is preferably of high coercivity so as to make segment 16 much more difficult for its magnetization to be changed by core 20 or coil 24.

One advantage of this invention is that the electrical pulse applied to the coil 24 need only be of sufficient duration to cause the core 20 to reverse its magnetic polarity. This is possible because there will remain in the core 20, after deenergization of the coil 24, a sufficient amount of residual magnetism to cause the display segment 16 to move toward and complete its travel to either the window 14 or the opposing surface 22, depending on the polarity. Energization of coil 24 so as to reverse the magnetization of the core 20 may, but need not, result in initial movement of the display segment 16 towards its ultimate destination position.

A further advantage of this invention is that the residual magnetism of the core 20 also enables the display device 10 to be bistable without the requirement of application of electrical energy to the coil 24. The residual magnetism in the core 20 is of sufficient magnitude to produce a repelling or attracting force that maintains the permanently magnetized display segment 16 in its new position until another electrical pulse is applied to the coil 24 to reverse the polarity of the core 20.

Figure 3A:
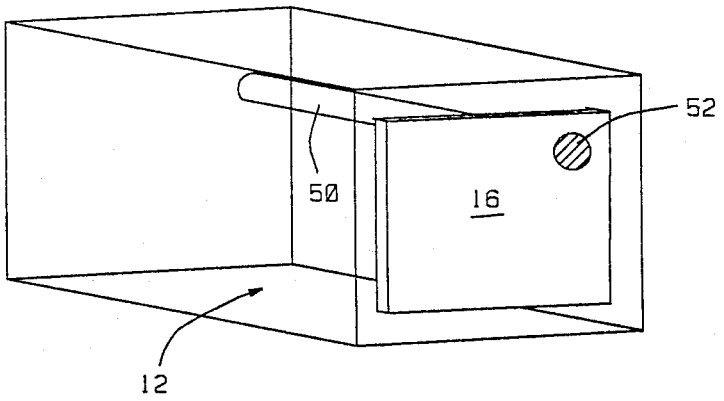
FIGS. 3A and 3B are partially cut away perspective and cross-sectional views of the chamber of the display device showing guide posts for guiding movement of the display segment shown in FIGS. 1 and 2.
Figure 3B:
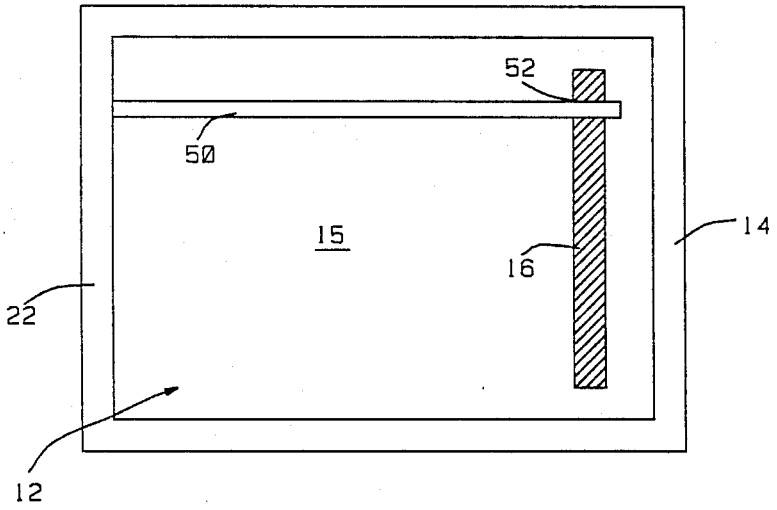

Referring to FIGS. 3A and 3B, partially cut away perspective views of chamber 12 are shown which indicate the relationship of the display segment 16 to a guide post 50 in accordance with the present invention. FIG. 3B shows the display segment 16 of this embodiment in a position corresponding to that shown in FIG. 2.

The guide post 50 is fixed within the chamber 12 between the transparent window 14 and the opposing surface 22. The display segment 16 is mounted on guide post 50, with guide post 50 extending through an opening 52 in the display element 16. Thus, as the display segment 16 moves from its position adjacent the transparent window 14 to the opposing surface 22, or vice versa, it is prevented by guide post 50 from rotating and from changing the parallel relationship of its colored surface 19 to the inner surface 17 of the transparent window 14. This not only prevents undesired wedging of the display segment 16 in the chamber 12 during movement of the display segment 16, but also maintains uniformity of the displayed information.

Figure 4A:
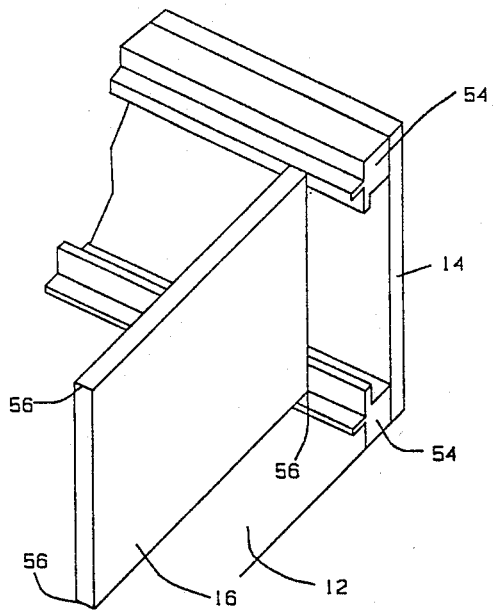
FIGS. 4A and 4B are partially cut away perspective and cross-sectional end views of the chamber of the display device showing guide rails for guiding the movement of the display segment shown in FIGS. 1 and 2.
Figure 4B:
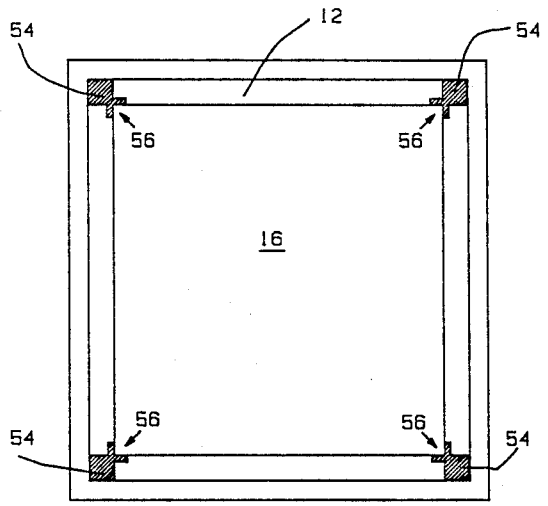

Referring to FIGS. 4A and 4B, partially cut away perspective views of chamber 12 are shown which indicate the relationship of the display segment 16 to guide rails 54 in accordance with the present invention.

The guide rails 54 are fixed within the chamber 12 between the transparent window 14 and the opposing surface 22. The guide rails 54 are shown placed at the corners of chamber 12 along the path of the display segment 16, but other placements of the guide rails 54 are within the teaching of this invention. The guide rails 54 are constructed so as to closely relate to the edges 56 of the display segment 16. Thus, the display segment 16 is constrained in its movement from its position adjacent the transparent window 14 to its position adjacent the opposing surface 22, or vice versa, such that rotation of the display segment 16 and alteration of the parallel relationship of the colored surface 19 and the inner surface 27 of the transparent window 14 are prevented. As with the embodiment of this invention using the guide post 50, this embodiment promotes unhindered movement of the display segment 16 and uniformity of displayed information.

Figure 5:
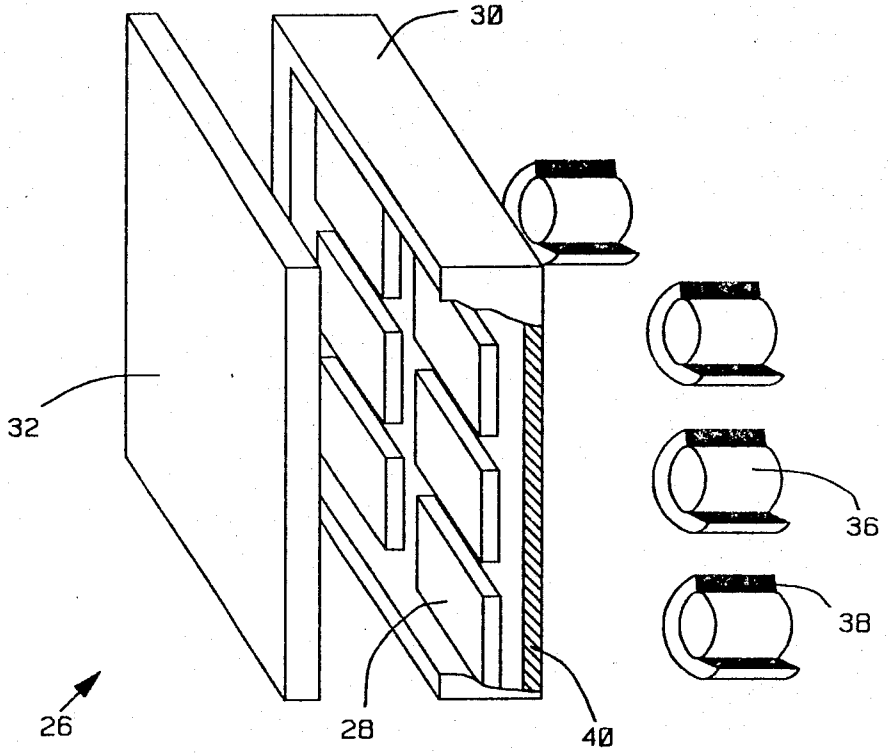
FIG. 5 is an exploded partially cutaway perspective view of an array of several representative display devices combined to form a display panel.

Referring to FIG. 5, shown is an exploded partially cut away cross-sectional view of a panel 26 comprising several representative display devices arranged in side-by-side relationship to form columns and rows of the devices for display of graphic or alphanumeric information.

In this embodiment, several display segments 28 may be movably mounted in a single chamber 30 which includes a single transparent window 32. Contained within the chamber 30 is an opaque fluid 34 which surrounds all of the display segments 28. This embodiment also includes one core 36 surrounded by one coil 38 for each of the display segments 28. Each core 36 and its associated coil 38 is affixed to the rear face of the opposing surface 40 of the chamber 30, directly behind the display segment 28 which is to be controlled by that core 36 and coil 38.

In the embodiment shown in FIG. 5, each of the display segments 28 is independently movable toward or away from the window 32 and each core 36 is independently energizable by its associated coil 38. The positions of the coils, cores, and other components of such an array of display devices are such that none of the components may interact with any other component to produce magnetic disturbances or other adverse effects. For example, mutual repulsion of the edges of adjacent display segments 16 can be significantly reduced by making each display segment 16 entirely of barium ferrite, but magnetizing only the center portion of each display segment. Alternatively, mutual repulsion can be reduced by embedding a permanent magnet in the center portion of each display segment 16 which is otherwise composed of plastic.

Other embodiments of the panel of display devices are possible, including those teaching united movement of all display segments 28, partially independent movement or movement in groups of the display segments 28, partially independent energization of the cores 36 by their associated coils 38, or the use of fewer cores 36 and coils 38 than the number of display segments 28. Each display segment 28 also need not be square or even of the same shape as adjacent elements. This enables adjacent segments 28 in an array to form alphanumeric symbols of any shape or other symbols or images. The guide post 50 shown in FIGS. 3A and 3B, or the guide rails 54 shown in FIGS. 4A and 4B may also be incorporated into the array embodiment shown in FIG. 5. Various spatial arrangements or configurations of display devices may also be used to advantage within the scope of the present invention.

Although the invention is shown in one embodiment of a single display device 10 and one embodiment of a panel 26 of several display devices, the invention is not limited to the embodiments illustrated or described and modifications and variations may be resorted to without departing from the spirit of the invention as understandable by those skilled in this art. Thus, the scope of the invention is to be determined by reference to the appended claims.

What is claimed is:

1. A display device comprising:

a chamber of non-magnetic material including a transparent window;

an opaque fluid container within said chamber;

a rigid, permanently magnetized display segment movably mounted within said chamber to be movable along a substantially linear path between a first position in which one face of the display segment is proximate said transparent window and a second position in which the one face of the display segment is spaced from said transparent window and the other face of said display segment is proximate a rear face of said chamber;

a magnetizable core affixed adjacent said rear face of said chamber; and means for selectively producing one of a first or second magnetic polarity state in said core, said first magnetic polarity state generating a first residual magnetic field of sufficient strength to repel said display segment so that said display segment moves in a substantially linear direction away from said core and to said first position, said second magnetic polarity state generating a second residual magnetic field of sufficient strength to attract said display segment so that said display segment moves in a substantially linear direction towards said core and to said second position, said polarity state producing means and said first and second residual magnetic fields being insufficient to demagnetize said display segment;

said permanently magnetized display segment having a magnetic field strength that is smaller than that required to reverse the magnetic polarity of said core.

2. The display device of claim 1 wherein said opaque fluid is of a first color and the one face of said display segment is of a second color which contrasts with said first color.

3. The display device of claim 1 wherein said opaque fluid obstructs external viewing of the one face of said display segment which faces said inner face of said transparent window when said display segment is not substantially in contact with said inner face of said transparent window.

4. The display device of claim 1 wherein the distance between said first position and said second position is approximately 4 mm–6 mm.

5. The display device of claim 1 wherein said display segment is movably mounted within said chamber so as to enable passage of said opaque fluid around the periphery of said display segment.

6. The display device of claim 1 wherein the specific gravity of said display segment is substantially similar to the specific gravity of said opaque fluid.

7. The display device of claim 1 wherein said core is made of a material of high magnetic remnance and low coercivity.

8. The display device of claim 1 wherein said core is made of alnico.

9. The display device of claim 1 wherein said core is made of hard iron.

10. The display device of claim 1 wherein said core is a composite of hard iron and soft iron.

11. The display device of claim 1 wherein said polarity state producing means includes a coil positioned about said core and means for selectively coupling an electrical current of predetermined magnitude and direction to said coil.

12. The display device of claim 1 wherein said one face of said display segment is an irregular surface.

13. The display device of claim 1 wherein said display segment has at least one hole formed therein for enabling the passage of opaque fluid during movement of said display member.

14. The display device of claim 1 wherein said display segment is made of a material of high coercivity.

15. The display device of claim 1 wherein said display segment is made of plastic impregnated with barium ferrite.

16. The display device of claim 15 wherein only a center portion of said display member is magnetized.

17. The display device of claim 1 wherein said display segment includes a plastic casing and a magnetic material positioned in the center of said plastic casing.

18. The display device of claim 17 wherein said magnetic material is barium ferrite.

19. The display device of claim 1 wherein said display segment is defined to include at least one guiding hole and further comprising a guiding post extending in said chamber from said transparent window to said rear surface of said chamber, said guiding post positioned to extend through said guiding hole so as to guide the movement of said display segment between said first position and said second position.

20. The display device of claim 1 further comprising a plurality of guiding rails extending in said chamber from said transparent window to said rear surface of said chamber, said guiding rails being closely disposed adjacent the periphery of said display segment so as to guide the movement of said display segment between said first position and said second position.

21. The display device of claim 1 further comprising a plurality of said display segments in side-by-side relationship movably mounted within said chamber.

22. The display device of claim 21 wherein said plurality of display segments are spaced equally along orthogonal axes forming rows and columns of said display segments.

23. The display device of claim 21 wherein each said display segment is independently moveable.

24. The display device of claim 23 further comprising a plurality of said magnetizable cores, one associated with each said display segment, and a plurality of said polarity state producing means, one associated with each said core.

25. The display device of claim 24 wherein said plurality of said magnetizable cores and said plurality of said polarity state producing means are equally spaced along orthogonal axes forming rows and columns of said cores and said means.

26. A display device comprising:

a chamber of non-magnetic material including a transparent window;

an opaque fluid contained within said chamber;

a rigid permanently magnetized display segment movably mounted within said chamber to be movable along a substantially linear path between a first position in which a first face of the display segment is proximate said transparent window and a second position in which said first face of the display segment is spaced from the transparent window and a second face of said display segment is proximate to a rear face of said chamber;

an electromagnet including a ferromagnetic core and an excitation coil means, said electromagnet affixed adjacent said rear face of said chamber; and, means for selectively reversing the magnetic polarity state of said core including means for generating an electric current in said coil means in a first direction sufficient to generate a magnetic field whose strength causes said core to be in a first magnetic polarity state, and means for generating an electric current in a second direction sufficient to generate a second magnetic field whose strength causes said core to be in a second magnetic polarity state, said first polarity state generating a first residual magnetic field of sufficient strength to repel said display segment so that said display segment moves in a substantially linear direction towards said core and to said first psotion, said second polarity state generating a second residual magnetic field of sufficient strength to attract said display segment so that said display segment moves in a substantially linear direction towards said core and to said second position, said first and second magnetic fields and said first and second residual magnetic fields being of insufficient strength of demagnetized said display segment;

said permanently magnetized display segment having a magnetic field strength that is smaller than that required to reverse the magnetic polarity of said core.

27. The display device of claim 26 further comprising a plurality of said display segments in side-by side relationship movably mounted within said chamber.

28. The display device of claim 27 wherein said plurality of display segments are spaced equally along orthogonal axes forming rows and columns of said display segments.

29. The display device of claim 27 wherein each of said display segments is independently movable.

30. The display device of claim 27 further comprising a plurality of said electromagnets each of which includes a ferromagnetic core and an excitation coil means and a plurality of said means for selectively reversing the magnetic polarity state of said cores, each one of said plurality of electromagnets and an associated one of said plurality of means for reversing the magnetic polarity state being operatively adjacent a respective one of said display elements.

31. The display device of claim 30 wherein said plurality of electromagnets and said plurality of means for selectively reversing the magnetic polarity state of said cores are equally spaced along orthogonal axes forming rows and columns of said electromagnets and said means.

* * * * *